US009126729B2

(12) United States Patent
Lavoie

(10) Patent No.: US 9,126,729 B2
(45) Date of Patent: Sep. 8, 2015

(54) LIDS FOR POSITIONING, HOLDING AND RETAINING TEA BAGS AND THE LIKE IN DISPOSABLE AND NONDISPOSABLE CUPS

(76) Inventor: Heather Lavoie, Tahoe City, CA (US)

( * ) Notice: Subject to any disclaimer, the term of this patent is extended or adjusted under 35 U.S.C. 154(b) by 7 days.

(21) Appl. No.: 13/368,736

(22) Filed: Feb. 8, 2012

(65) Prior Publication Data

US 2012/0201941 A1 Aug. 9, 2012

Related U.S. Application Data

(60) Provisional application No. 61/441,019, filed on Feb. 9, 2011.

(51) Int. Cl.

| | |
|---|---|
| ***B65D 41/56*** | (2006.01) |
| ***A23F 3/34*** | (2006.01) |
| ***B65D 51/24*** | (2006.01) |
| ***B65D 43/02*** | (2006.01) |
| ***B65D 85/812*** | (2006.01) |

(52) U.S. Cl.

CPC ..... *B65D 51/24* (2013.01); *B65D 43/0212* (2013.01); *B65D 85/812* (2013.01); *B65D 2543/00046* (2013.01); *B65D 2543/00092* (2013.01); *B65D 2543/00296* (2013.01); *B65D 2543/00351* (2013.01); *B65D 2543/00527* (2013.01); *B65D 2543/00537* (2013.01); *B65D 2543/00638* (2013.01); *B65D 2543/00685* (2013.01); *B65D 2543/00731* (2013.01); *B65D 2543/00796* (2013.01)

(58) Field of Classification Search

CPC .. B65D 43/0212; B65D 51/24; B65D 85/812; B65D 2543/00046; B65D 2543/00092; B65D 2543/00296; B65D 2543/00796; B65D 2543/00527; B65D 2543/00537; B65D 2543/00638; B65D 2543/00685; B65D 2543/00731; B65D 2543/00351

USPC ..... 426/435; 220/21.2, 713

IPC ..... B65D 43/0212, 51/24, 85/812, 2543/00046, B65D 2543/00092, 2543/00296, 2543/00796, B65D 2543/00527, 2543/00537, 2543/00638, B65D 2543/00685, 2543/00731, 2543/00351

See application file for complete search history.

(56) References Cited

U.S. PATENT DOCUMENTS

| | | | | |
|---|---|---|---|---|
| 933,917 A | | 9/1909 | Norwood | |
| 1,002,376 A | | 9/1911 | Doty | |
| 1,664,226 A | | 3/1928 | Silver | |
| 1,723,702 A | | 8/1929 | Mitchell | |
| 1,785,878 A | * | 12/1930 | Schachter | 99/295 |
| 1,795,535 A | | 3/1931 | Anders | |
| 2,004,883 A | | 6/1935 | Wolcott | |
| 2,187,029 A | | 1/1940 | Hevers | |

(Continued)

FOREIGN PATENT DOCUMENTS

DE 3729018 A1 * 3/1989

*Primary Examiner* — Michele L Jacobson
*Assistant Examiner* — Subbalakshmi Prakash
(74) *Attorney, Agent, or Firm* — Lewis B. Sternfels

(57) ABSTRACT

A tea bag string securable to a lid for a cup enables the bag to be positioned into the cup liquid for removal therefrom and thereafter for storage within the lid underside. A string holding tab on the lid comprises a slotted notch in the tab or a hook formation extending from the lid and enables the string to be secured to the lid. A bag-holding strip extending over the lid underside retains the bag therewithin. The strip may be integral with or separate from the lid. If separate, the strip has a cup-engaging rim that can snap the strip over the container lip.

14 Claims, 19 Drawing Sheets

(56) References Cited

U.S. PATENT DOCUMENTS

| | | | | |
|---|---|---|---|---|
| 2,284,087 | A | 5/1942 | Ferguson | |
| 2,843,087 | A | 5/1942 | Ferguson | |
| 2,328,599 | A | 9/1943 | Armstrong | |
| 2,358,556 | A | 9/1944 | Block | |
| 2,800,408 | A | 7/1957 | Fimple | |
| 2,905,074 | A | 9/1959 | Newman | |
| 3,237,550 | A | 3/1966 | Christopher | |
| 3,517,604 | A | 6/1970 | Coors | |
| 3,861,284 | A | 1/1975 | Costello | |
| 4,183,444 | A | 1/1980 | English et al. | |
| 4,579,236 | A | 4/1986 | Zimmermann | |
| 4,589,569 | A | 5/1986 | Clements | |
| 4,602,557 | A | 7/1986 | Yip | |
| 4,864,921 | A | 9/1989 | Ross | |
| 6,314,866 | B1 * | 11/2001 | Melton | 99/322 |
| 7,140,510 | B2 | 11/2006 | Portman et al. | |
| 7,523,534 | B2 | 4/2009 | McKenzie et al. | |
| 7,676,909 | B2 | 3/2010 | McKenzie et al. | |
| 2006/0180028 | A1 * | 8/2006 | Burchard | 99/275 |
| 2006/0226147 | A1 * | 10/2006 | Phillips | 220/254.2 |
| 2007/0051738 | A1 | 3/2007 | Slayton | |
| 2008/0128437 | A1 * | 6/2008 | Portman et al. | 220/713 |
| 2009/0008390 | A1 * | 1/2009 | Robinson | 220/212 |
| 2009/0056556 | A1 * | 3/2009 | Lin | 99/289 R |

* cited by examiner

LIDS FOR POSITIONING, HOLDING AND RETAINING TEA BAGS AND THE LIKE IN DISPOSABLE AND NONDISPOSABLE CUPS

CROSS-REFERENCE TO RELATED APPLICATION

This application claims the benefit of U.S. Provisional Application No. 61/441,019, filed 9 Feb. 2011.

REFERENCE REGARDING FEDERAL SPONSORSHIP

Not Applicable

REFERENCE TO MICROFICHE APPENDIX

Not Applicable

FIELD OF THE INVENTION

The present invention relates to lids for positioning, holding and retaining tea bags and the like in containers, whether disposable or not and a method for effecting such positioning, holding and retaining.

DESCRIPTION OF RELATED ART AND OTHER CONSIDERATIONS

Difficulties exist with respect to the handling of tea bags and the like as used with containers, whether disposable or not. A customary method of such handling is as follows. By holding the tea bag string, the user dips or otherwise places the tea bag into a container containing, for example, hot water, to permit the tea bag contents to steep for a desired period of time so as to enable the tea essence to flavor the water or otherwise to be infused therein, and then removes the tea bag from the container. Such dipping can result in the string and attached tag falling into the container along with the tea bag, which then requires the user to remove the bag with a spoon or even by his or her fingers. Even if such an incident does not occur, the tea bag must be pulled from the hot liquid, usually accompanied by hot liquid dripping from the bag, and finally must be placed in an accessible receptacle or, if such a receptacle is unavailable, on a nearby napkin or on a table. Such operations occur whether or not the container includes a lid, which may not otherwise be used in conjunction with the tea bag.

SUMMARY OF THE INVENTION

These and other problems are successfully addressed and overcome by the present invention by employing one or more mechanisms associated with the lid that enables both the tea bag and its string to be so controlled and positioned as to avoid the above-noted problems. Such mechanisms include a string grasping or holding device, preferably comprising a notch or other implementation associated with the lid alone or with the container for enabling the string to be positioned and held against the lid, and a holder for holding the tea bag against the lid. Thus, the mechanisms are used to grasp the string and to attach the tea bag to the lid and/or retain the tea bag in or with the lid. The string grasping or holding mechanism and the bag holder, which are both associated with the lid, consequently provide the manner by which the tea bag string is held in association with the lid, so as to enable the tea bag to be placed into the liquid, to be pulled out of the liquid, to be retained in or with the lid, and to be held to the lid or otherwise controlled following its immersion in the liquid.

In operation, once the liquid is poured into the container, the string of a tea bag is slid into the notch or other grasping implementation located on the inner or outer rim of the lid alone or with the container with the tail end of the tea bag hanging on the outside of the container. When the lid is placed on the container, the hanging tea bag is provided with enough length of the string to permit the tea bag to reach and be immersed into the liquid in the container. Once a desired steeping time has occurred, the lid may be lifted slightly or the string pulled between the lid and the container as coupled together where the tail end of the string can be pulled to enable the tea bag to come into contact with the underside of the lid. The tea lid may then turned over to create a dish or bowl or like receptacle, using the rim as sides, to contain any excess liquid coming from or otherwise seeping from the tea bag. An additional holding mechanism, in a preferred embodiment, is so constructed as to hold and maintain the tea bag against the interior of the lid. Such lids, as are used with disposable containers, often contain an opening or hole through which the user can sip the contents from the container. To prevent seepage from the used tea bag from flowing into such an opening or hole, a berm and outside channel may be provided adjacent the hole to act as an obstruction.

Several advantages are derived from this arrangement. Control and handling of a tea bag or the like is provided before, during and after its insertion into a container and its immersion into the contained liquid. Immersion of the bag into the container and the liquid therein is kept in check as desired by the user. Retention of the bag after its immersion is provided so as to prevent or avoid dripping of liquid outside of the container. Such retention is enabled by using the lid as a receptacle for the bag and for fastening it to the lid.

Other aims and advantages, as well as a more complete understanding of the present invention, will appear from the following explanation of exemplary embodiments and the accompanying drawings thereof.

DETAILED DESCRIPTION

Figure 1:
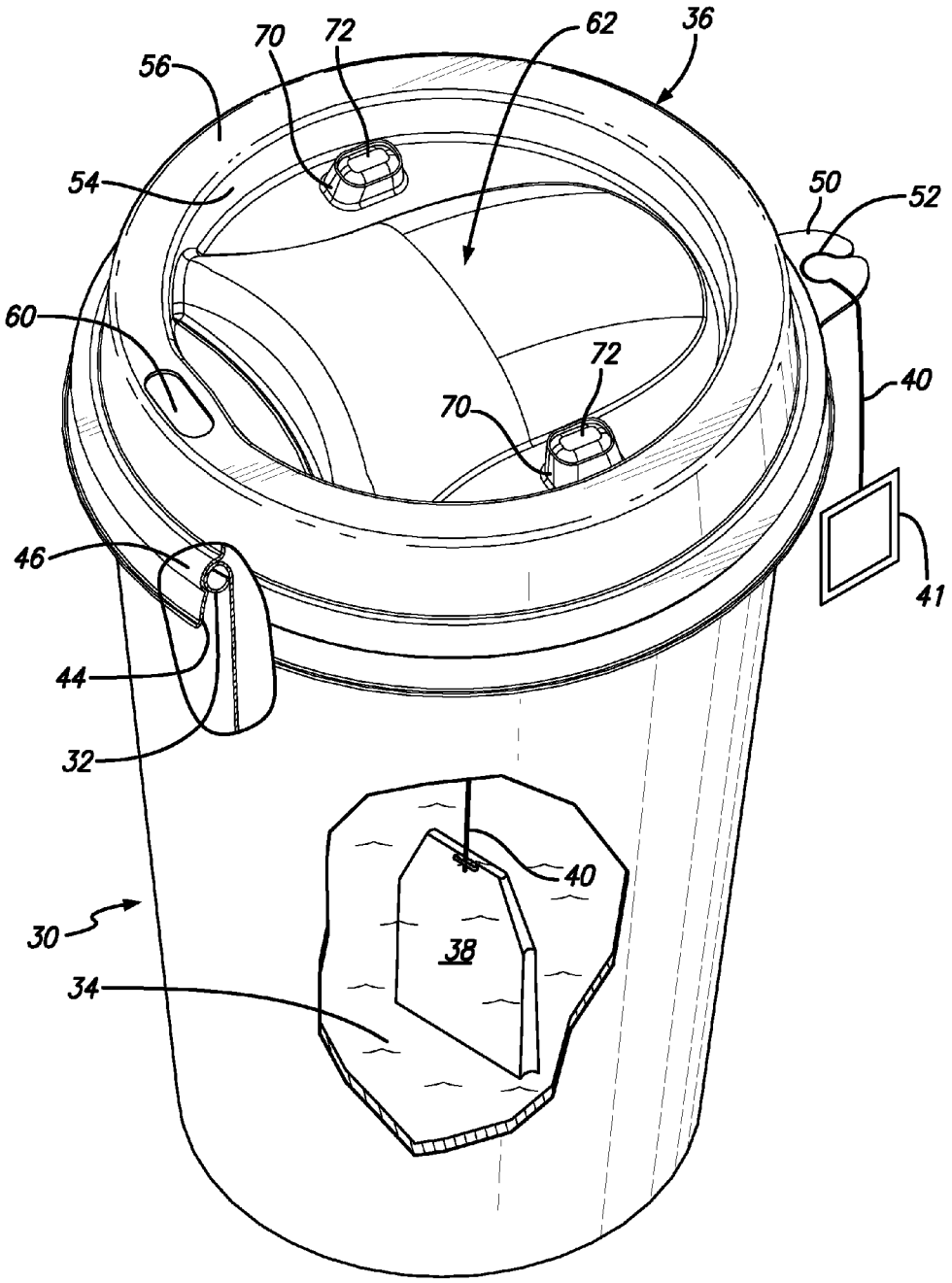
FIG. 1 is a perspective view of a first embodiment of the present invention illustrating a beverage container of disposable constitution and lid therefore with a tea bag string held in its lid tea bag holding notch.
Figure 2:
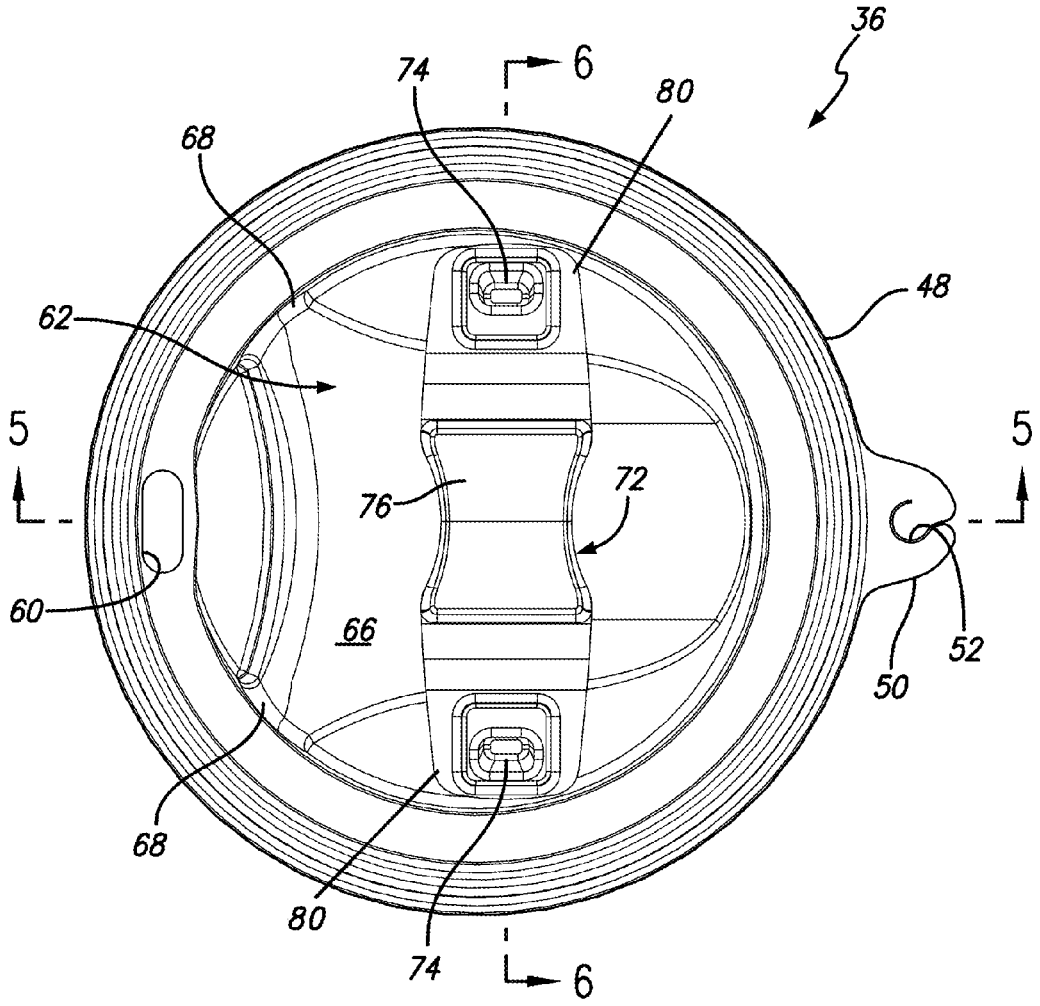
FIG. 2 is a view of the interior of the lid shown in FIG. 1 without the tea bag or string.
Figure 3:
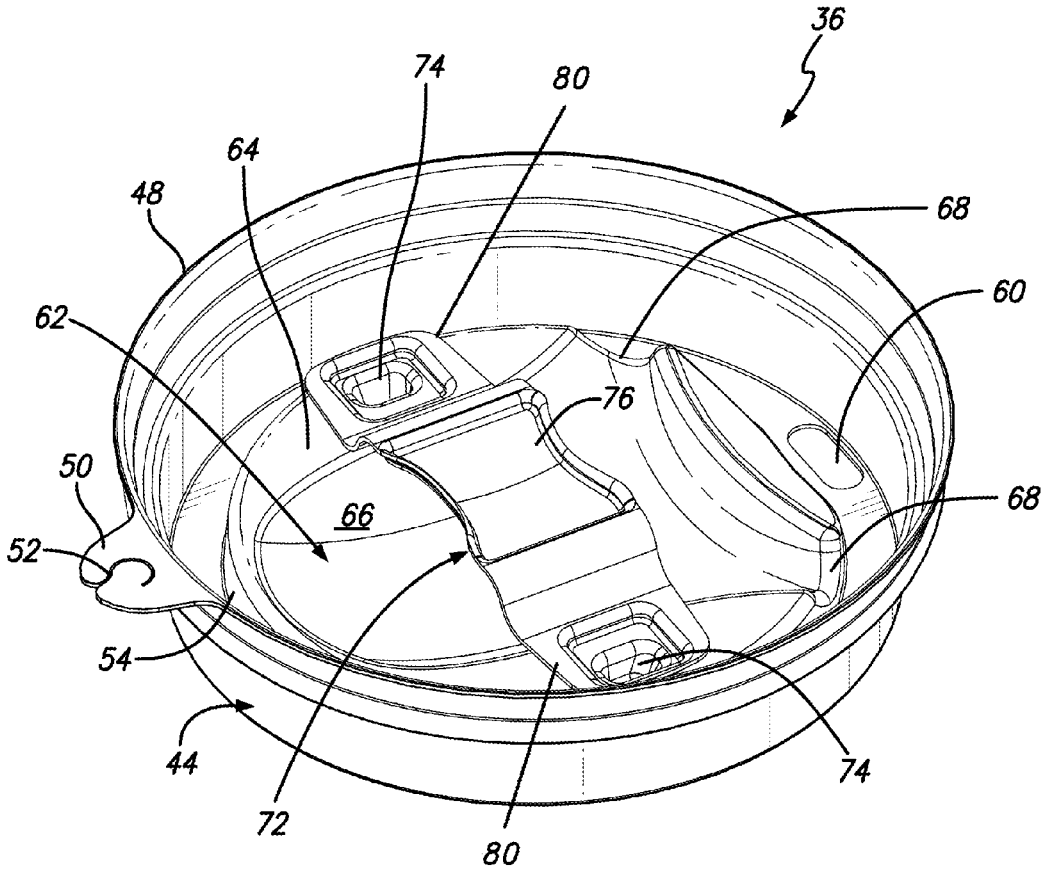
FIG. 3 is a perspective view of the lid depicted in FIG. 2 illustrating details of its interior including a tea bag holder latched to or snapped onto the inside surface of the lid.
Figure 4:
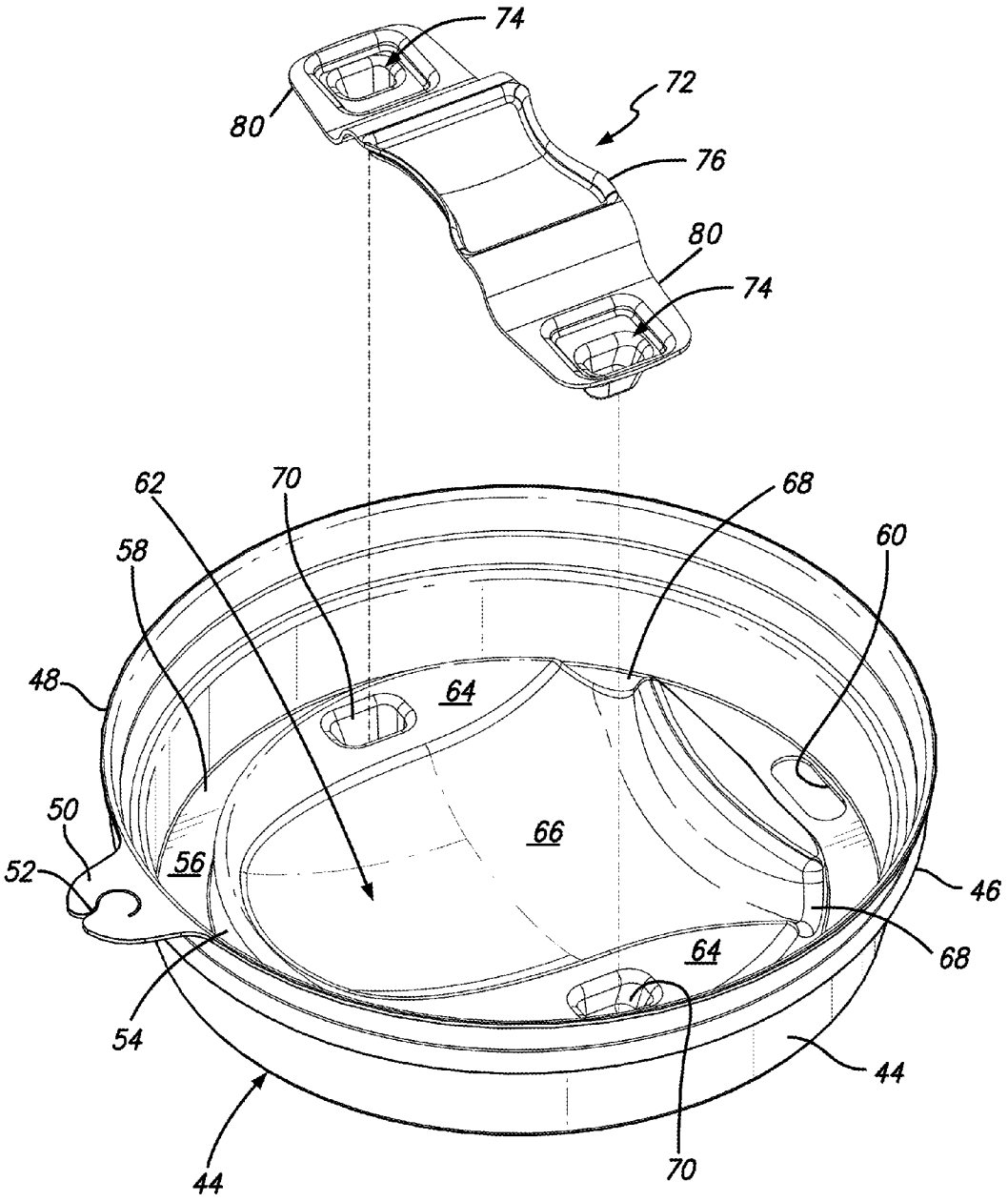
FIG. 4 is a perspective view of the lid as shown in FIG. 3 showing the tea bag holder distanced from the lid interior surface and so positioned as to demonstrate how it can be snapped into or latched to the lid.

Accordingly, FIGS. 1-13 illustrate a first embodiment of the present invention characterized as a disposable cup or beverage container 30, e.g. of plastic or fiber material, having a mouth or lip 32. Cup or container 30 is used to contain a liquid 34, e.g., hot water, and is closeable by a lid 36. For example, cup or container 30 is employed to contain hot water to be flavored by tea. Accordingly for purposes of such exposition as its tea-holding use, such exposition is illustrated by the picturing of a tea bag 38 having a string 40 and a tag or tail 41 attached to the end of the string opposite from the tea bag.

Figure 5:
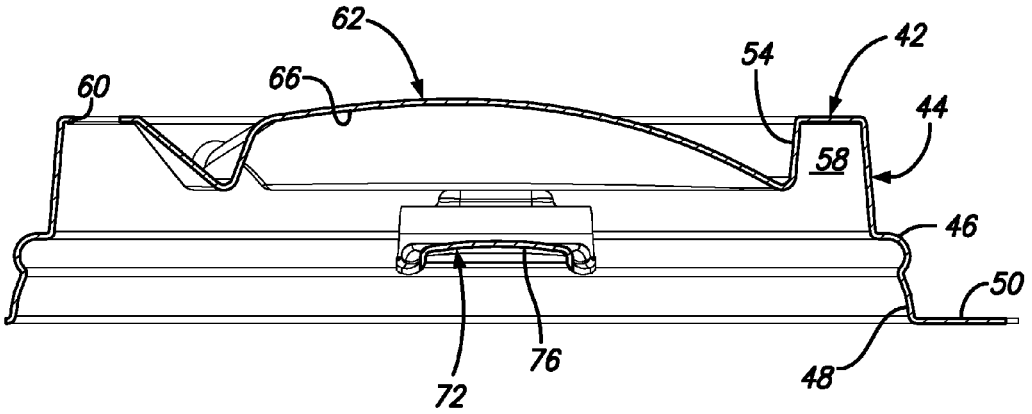
FIG. 5 is a cross-sectional view of the lid shown in FIG. 2 taken along sectional line 5-5 thereof.
Figure 6:
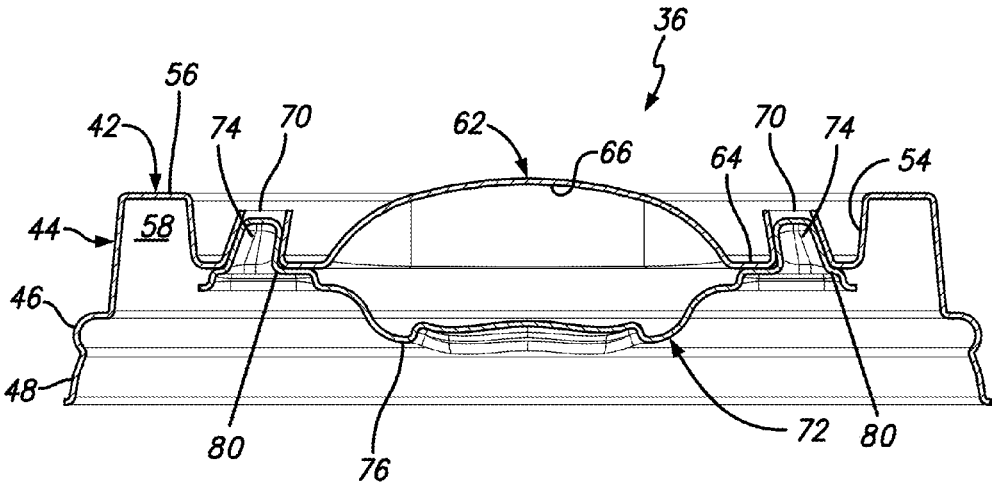
FIG. 6 is a side view in cross-section of the lid depicted in FIG. 2 taken along sectional line 6-6 thereof.
Figure 7:
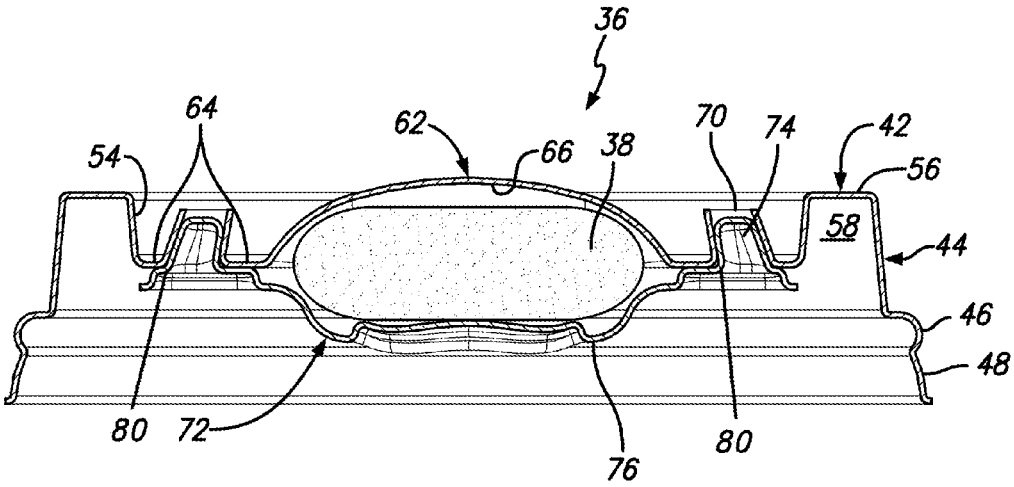
FIG. 7 is a side view in cross-section of the lid depicted in FIG. 6 and illustrating the tea bag held therein.

As shown, for example, in FIGS. 5-7, lid 36 includes a base portion 42 and an outer wall 44 extending therefrom. Wall 44 terminates in a snap-over rim 46 and a guide 48, which guide is disposed to guide rim 46 over container lip 32 for enabling rim 46 to snap over the container lip, and thus to attach the lid to cup or container 30 and to later enable the lid to be removed from the cup/container. A tab 50 (see FIGS. 1-5 and 9-13) is formed on rim guide 48 and extends therefrom. The tab may be configured as a flexible member composed of a thin, relatively rigid plastic into which a slit 52 is formed, which slit has a hook-shaped configuration for reception and gripping retention therein of tea bag string 40.

Base portion 42 of the lid includes an inner wall 54, that is, inner with respect to outer wall 44. As illustrated in the first embodiment, outer and inner walls 44 and 54 are ring-shaped and spaced from one another by a connecting wall 56. The combination of outer wall 44, inner wall 54 and connecting wall 56 defines an annular liquid conduit or channel 58. An opening 60 in connecting wall 56 enables a user to imbibe the liquid from cup/container 30 when lid 36 is snapped thereto. A central portion 62 is skirted by inner wall 54 (alternatively termed "skirting wall") and defines an included berm structure 64. A bag-receiving area or indentation 66 is adapted to hold bag 38 following its insertion into and removal from contained liquid 34. Channels 68 (see FIGS. 2-4) are formed in the berm structure and provide a fluid coupling between bag-receiving indentation 66 and annular liquid conduit 58.

Coupling indents or, for example, openings 70 (e.g., see FIG. 4) are formed in berm structure 64. A bag holder 72 having protruding detents 74 at its ends 80 and a central portion 76 is placeable over central bag-receiving indentation 66. Detents 74 are disposed to engage coupling indents 70 for enabling the coupling of bag holder 72 to berm structure 64 by which the bag holder enables retention of the tea bag within central bag-receiving indentation 66.

Figure 8:
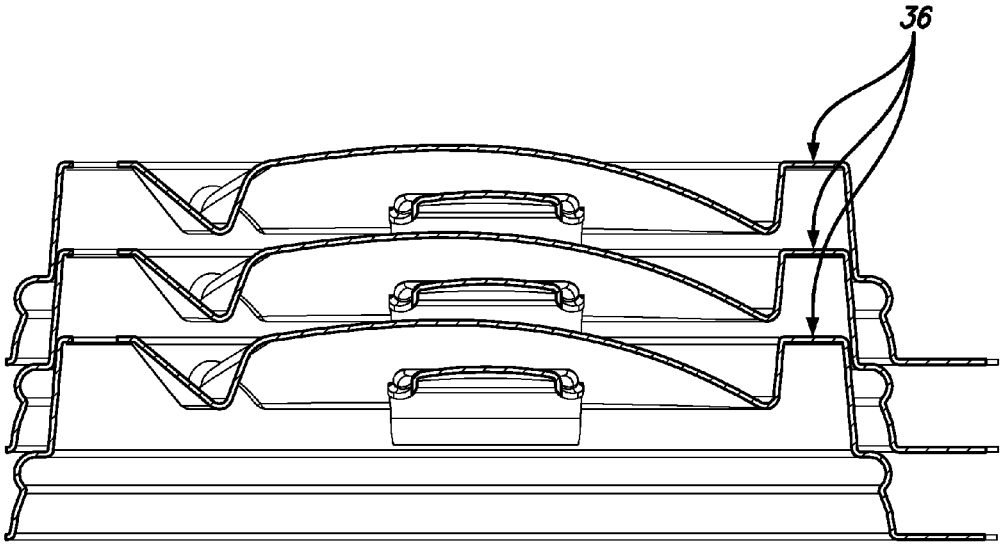
FIGS. 8 and 9 are views, respectively in cross-section and perspective, of how several lids may be stacked together, such as for purposes of storage or in preparation for use.
Figure 9:
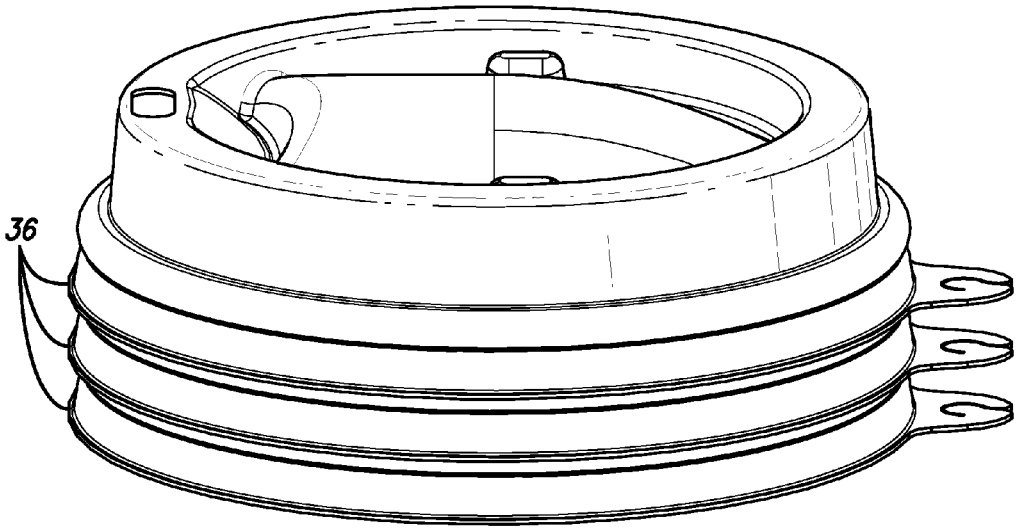
Figure 10:
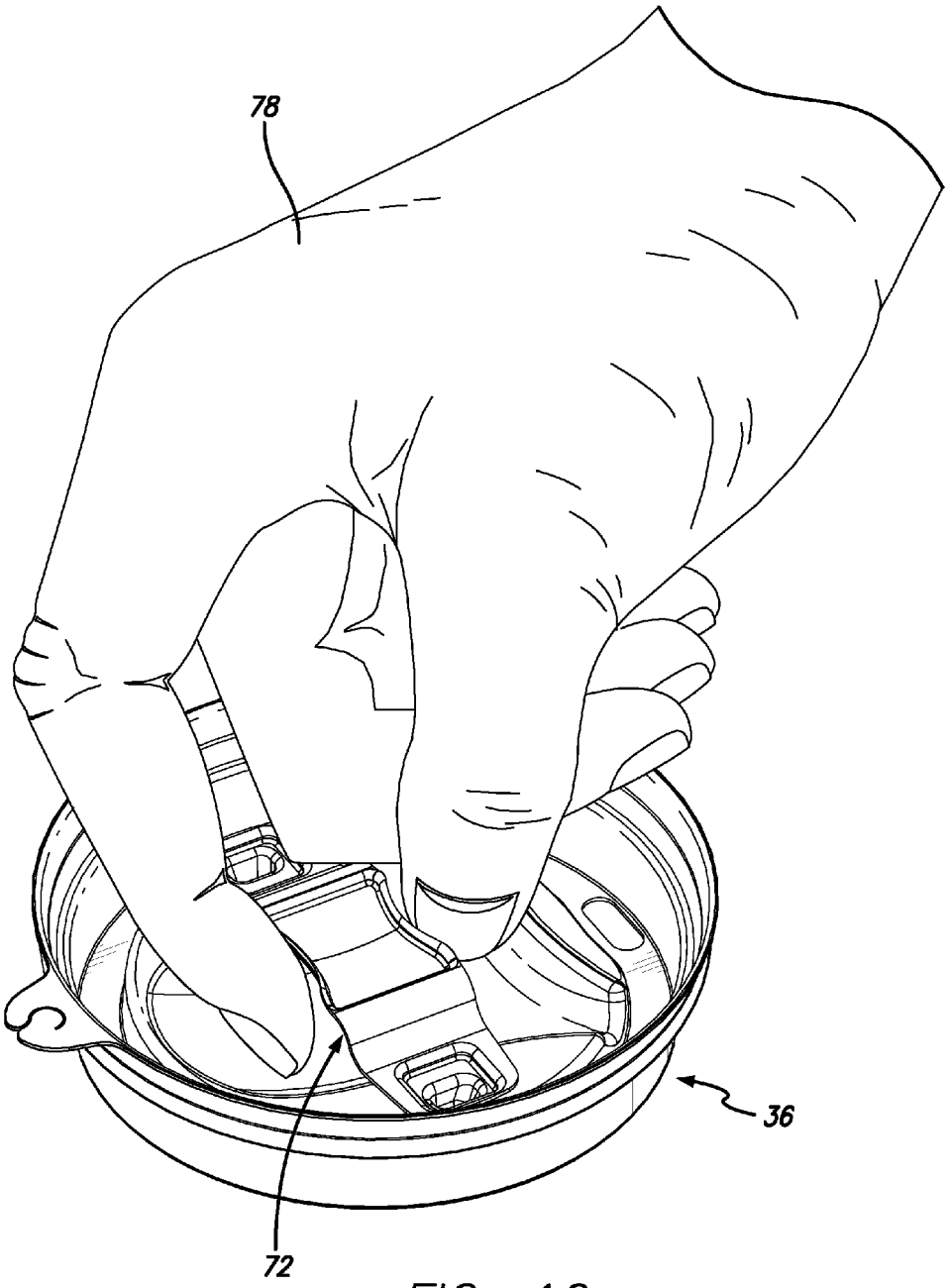
FIG. 10 is a perspective view of the lid as illustrated in FIG. 3 depicting how the tea bag holder may be grasped by a user for either its removal from or attachment to a lid.
Figure 11:
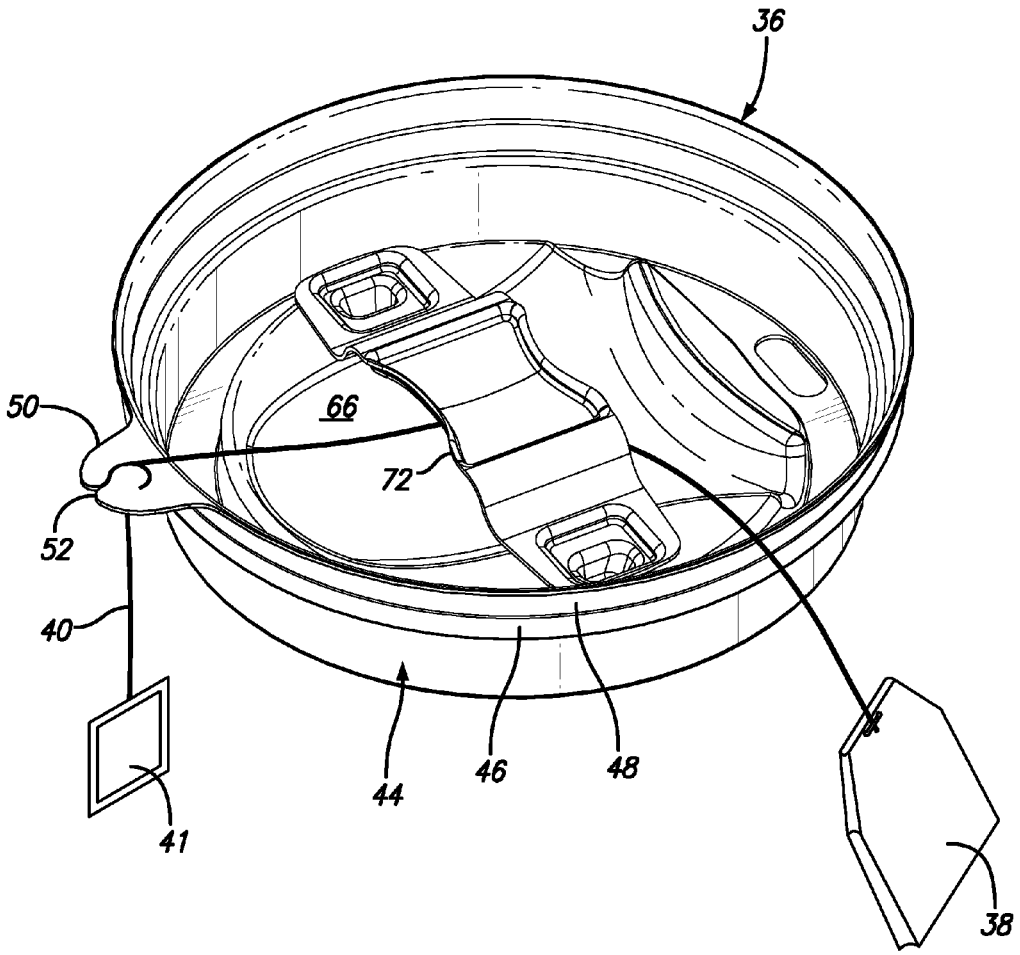
FIG. 11 is a perspective view of the lid as illustrated in FIG. 3, further depicting how the tea bag string may be placed under the holder following its having been grasped and manipulated, for example as shown in FIG. 10.
Figure 12:
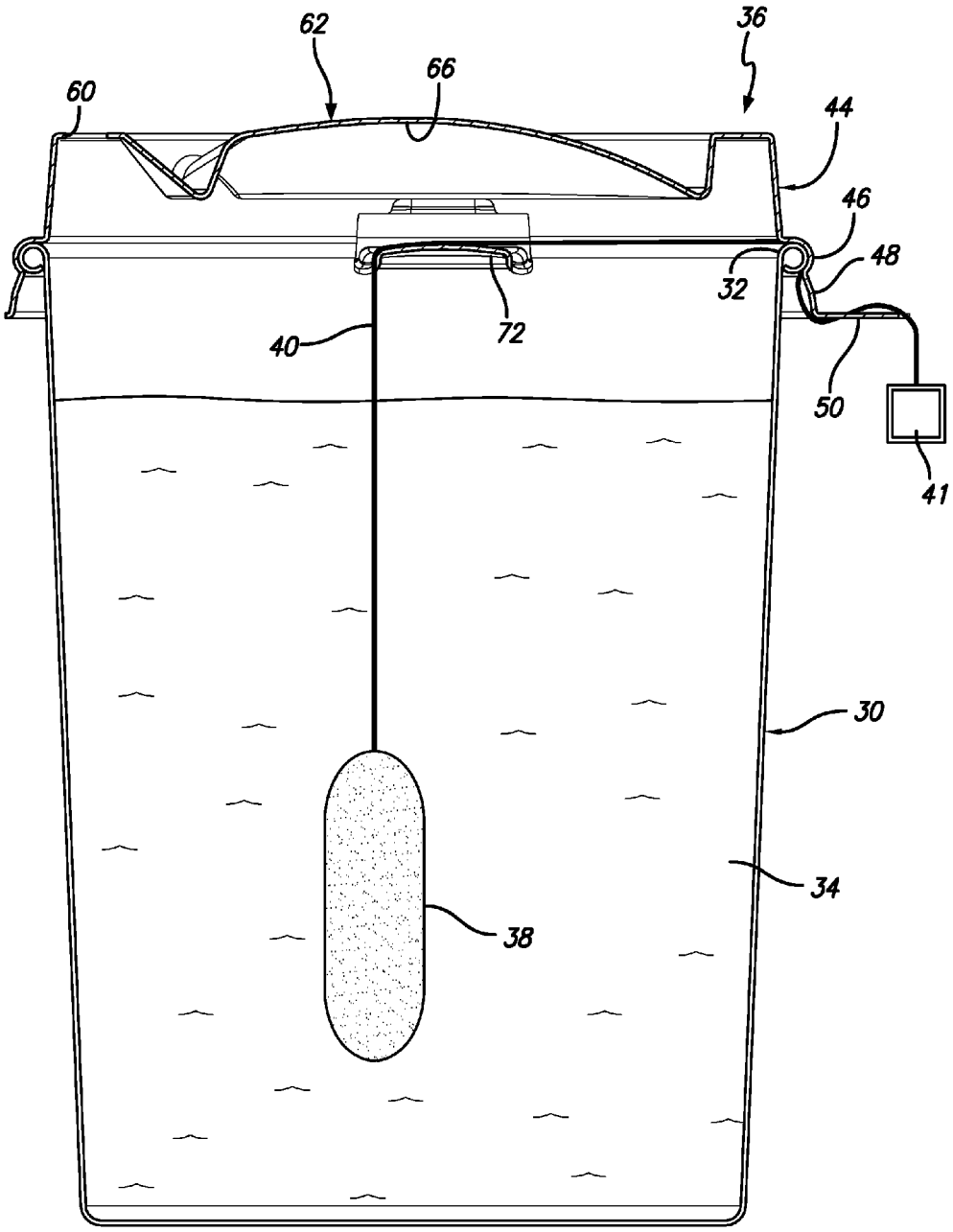
FIG. 12 is a cross-sectional view of a container with liquid therein with the tea bag string held within the lid, as depicted in FIG. 11, and the tea bag placed within the contained liquid.
Figure 13:
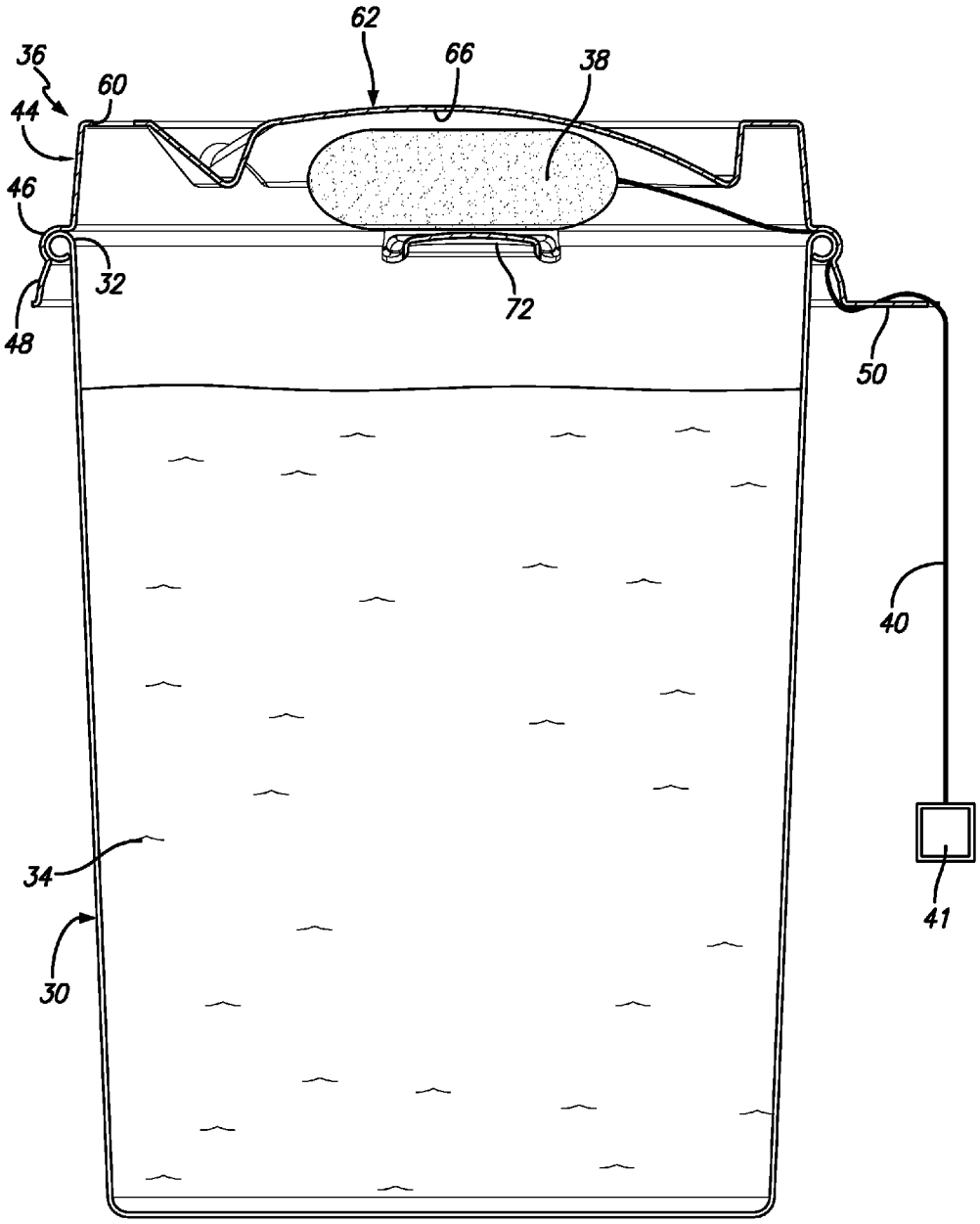
FIG. 13 is a cross-sectional view of the container with liquid therein with the tea bag withdrawn from the contained liquid and resting against and held to the lid by the tea bag holder, as so positioned by pulling of the tea bag string through the slotted tab.

FIGS. 8 and 9 illustrate how more than one lid may be stacked together for storage or as being ready for use.

Use of the embodiments previously described may be understood with respect to FIGS. 10-13. In operation, once the liquid is poured into the container, by manipulation of holder 72 as exemplified in FIG. 10 by a user and as shown by a user's hand and fingers 78, string 40 of tea bag 38 is placed between holder 72 and tea bag-receiving indentation 66, such as by placing the string onto indentation 66 and snapping the holder onto the lid or by threading tag 41 and string 40 between the already secured together holder and lid. String 40 is then slid into slit 52 of tab 50 with tail end 41 of the tea bag hanging on the outside of container 30.

When lid 36 is placed on the container, the hanging tea bag is provided with enough length of the string as to permit the tea bag to be inserted into the liquid in the container and to be saturated thereby. Once a desired steeping time occurs, the lid may be lifted slightly, or not lifted as desired, at which time the tail end of the string can be pulled to enable the tea bag to be pulled out of liquid 34 into contact with the lid, and between holder 72 and lid indentation 66 for being held to the lid. The flavored liquid may then be sipped by a user through opening 60. Alternately, if holder 72 had not previously been secured to the lid, the tea lid may be turned over to contain any excess liquid coming from or otherwise seeping from the tea bag and to avail the use of tea bag-receiving indentation or receiving area 66. Bag holder 72 would then be placed over the tea bag and its detent elements 74 snapped into coupling indents 70 of berm structure 64 to secure the tea bag in place.

Figure 14:
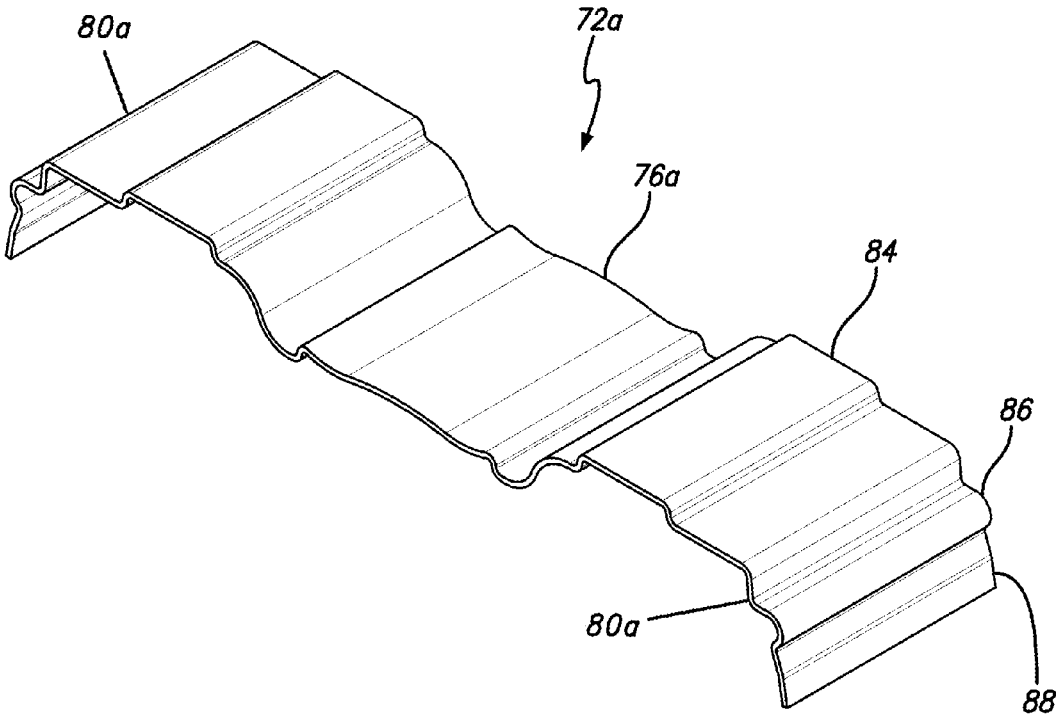
FIGS. 14, 15A and 15B are views of a second embodiment of the present invention respectively showing, in perspective, a stand-alone tea bag holder and, in cross-section, the stand-alone holder and lid placed over and respectively snapped over the rim of a container, with FIGS. 15A and 15B illustrating different means for holding and gripping the tea bag string.
Figure 15A:
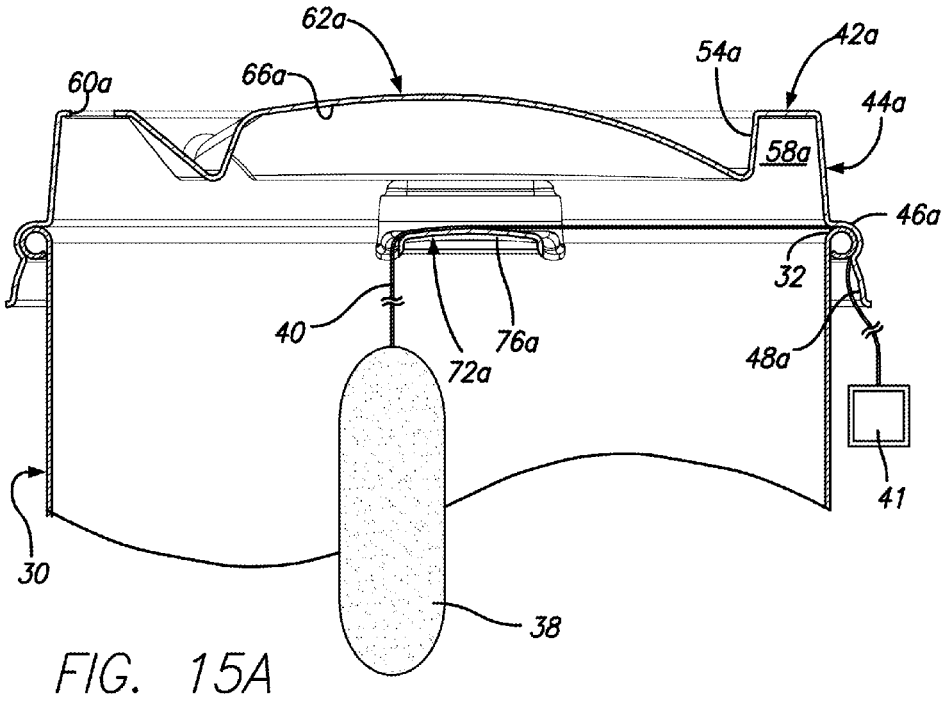
Figure 15B:
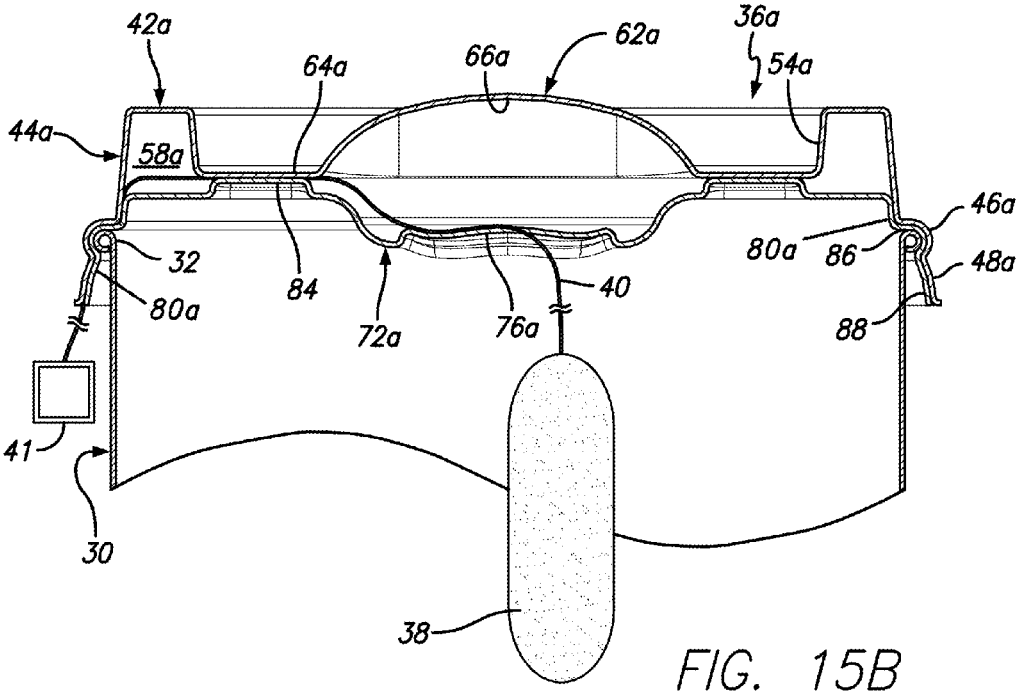

Reference is now directed to FIGS. 14, 15A and 15B in which a second embodiment of the present invention comprises a tea bag holder 72*a* formed as an independent element, e.g., as a bar, that is, one which is separate from or not molded to a lid 36*a*. Lid 36*a*, like lid 36 of the prior figures, includes a base portion 42*a* and an outer wall 44*a* extending therefrom. Wall 44*a* terminates in a snap-over rim 46*a* and a guide 48*a*. The combination of outer wall 44*a*, inner wall 54*a* and connecting wall 56*a* defines an annular liquid conduit or channel 58*a*.

Unlike lid 36, however, lid 36*a* includes a central portion 62*a* comprising a berm structure 64*a* which is flat and imperforate but, like lid 36, is connected to a tea bag-receiving area or indentation 66*a*.

Tea bag holder 72*a* includes an intermediary connector 84 terminating at its ends 80*a* in a snap-over rim 86 and a guide 88 therefor, which guide 88 is disposed to guide rim 86 over container lip 32 for enabling rim 86 to snap over the container lip. In this embodiment, snap-over rim 46*a* of lid 36*a*, as guided by lid guide 48*a*, is enabled to snap over holder rim 86. When lid 36*a* and holder 72*a* are so snapped together, berm structure 64*a* of lid 36*a* firmly contacts intermediary connector 84 of holder 72*a* so as to aid in forming a firm and stable interconnection therebetween. Also, this construction permits both lid 36*a* and bar holder 72*a* to be removed independently or together from cup or container 30. While a tab, similar to tab 50 shown in FIGS. 1-5, may or may not be employed with lid 36*a* or, alternatively, be formed on holder 72*a*, such a tab may not be needed, as discussed below with respect to the operational discussion of this embodiment.

In the operation as displayed in the FIGS. 14 and 15A embodiment, bar holder 72*a* is first snapped over lip 32 of container 30. The tea bag string is then draped over intermediary connector 84 of holder 72*a* so that the tea bag resides within the container and in any liquid therein and its tag (e.g. tag 41) extends outside of the container. Lid 36*a* is then snapped over holder 72*a* and lip 32 of the container. When so engaged, tea bag string 40 is gripped by the engagement between snap-over rim 46*a* of lid 36*a* and container lip 32. This gripping engagement is sufficient to hold the tea bag stationary within the liquid and, also, to enable the string and the connected tea bag to be pulled from the container and held between bar holder 72*a* and indentation or receiving area 66*a*.

Furthermore, if desired but not necessarily so needed as depicted in FIG. 15B, the tea bag string may be initially so placed as to be gripped between lid berm structure 64*a* and intermediary connector 84 of holder 72*a* as well as between snap-over rim 46*a* and guide 48*a* of lid 36*a*. Therefore, there may be performed a double gripping function. This enables the tea bag string to be gripped by the engagement between the combination of snap-over rim 46*a* and guide 48*a* of lid 36*a* with the combination of snap-over rim 86 and guide 88 of holder 72*a*. When lid 36*a* is secured over holder 72*a*, the pressing connection between lid berm structure 64*a* and intermediary connector 84 of holder 72*a* firmly grips the tea bag string.

Therefore, because such single or multiple string-gripping, as elucidated with respect to FIGS. 15A and 15B, performs a similar function as a tab, e.g., tab 50, such a tab may be dispensed with in this embodiment.

Figure 16:
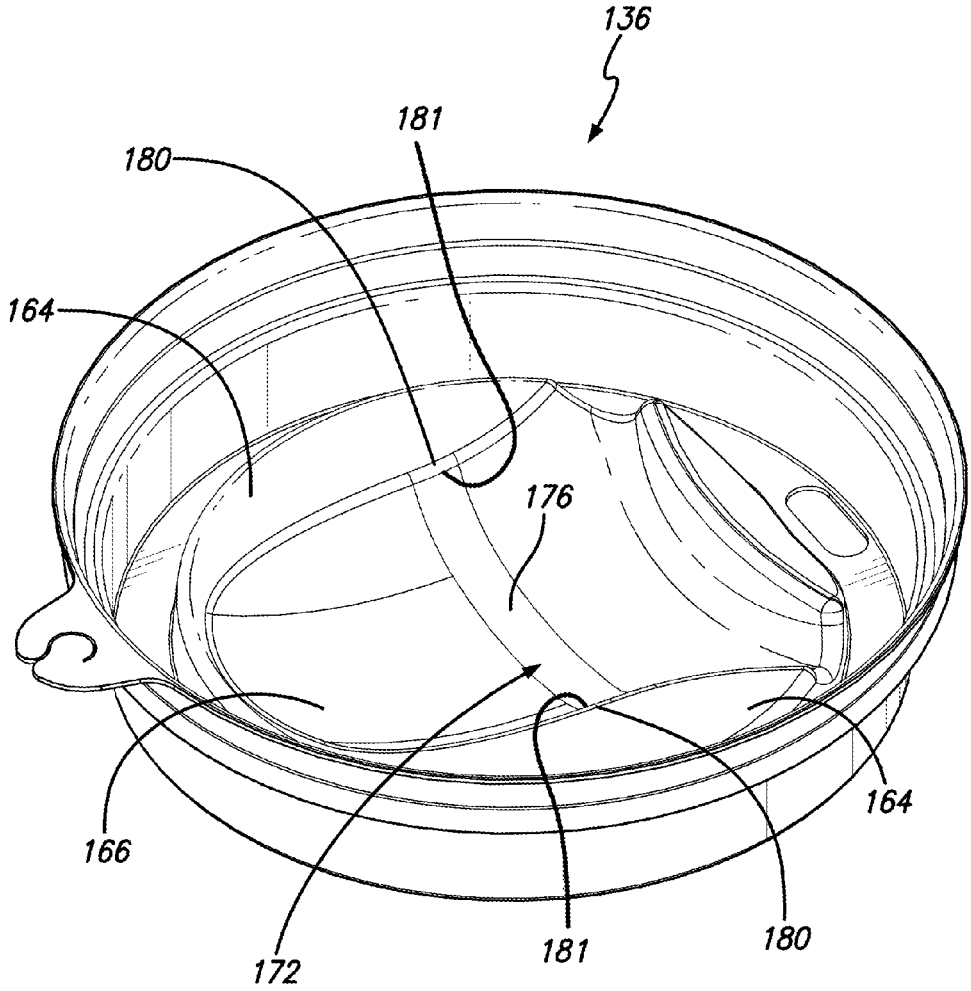
FIG. 16 is a perspective view of a third embodiment of the present invention illustrating a view of a variant of a bag holder as depicted in previous figures for retaining a bag within and against the interior of a lid.
Figure 17:
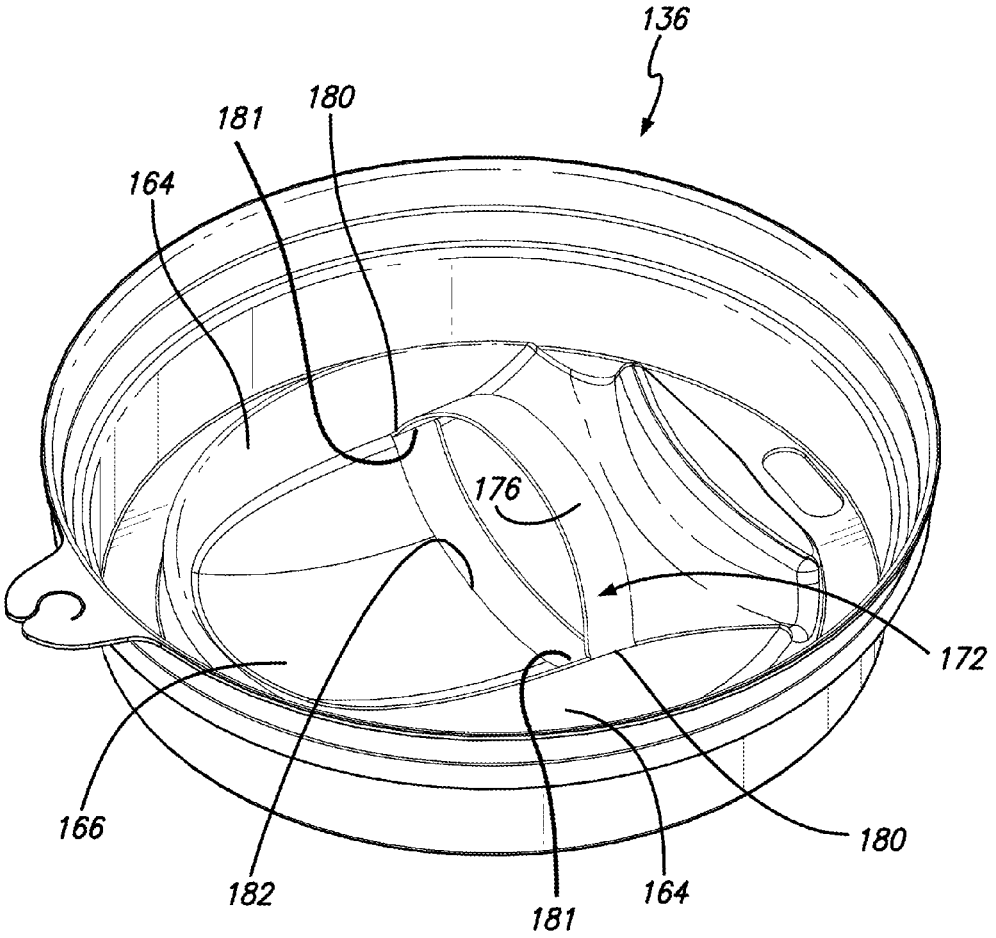
FIG. 17 is a perspective view of the embodiment shown in FIG. 16 but with the bag retainer/holder moved away from the lid receptacle in position to receive a used tea bag.
Figure 18:
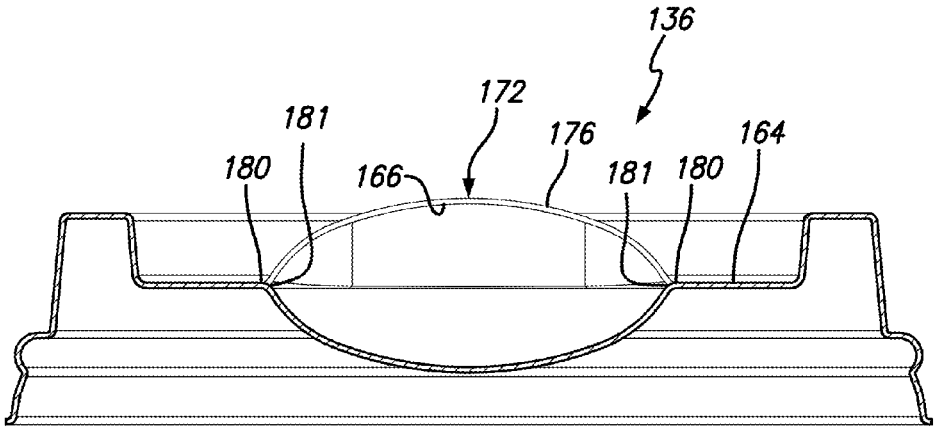
FIG. 18 is a side view in cross-section of the lid depicted in FIGS. 16 and 17 without a tea bag being held therein by the holder therefore.
Figure 19:
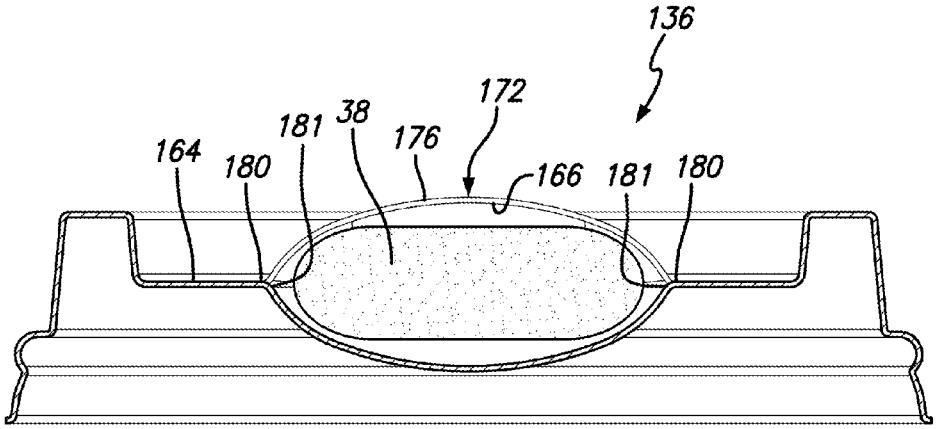
FIG. 19 is a side view in cross-section of the lid depicted in FIG. 18 with a tea bag held therein by the holder therefore.

Referring now to FIGS. 16-19 which depict a third embodiment of the present invention as embodied in a lid 136, a simpler form of bag holder is employed, as identified by indicium 172. Bag holder 172, rather than being securable to berm structure 164 as disclosed in FIGS. 1-8, is preferably molded as part of lid 136, being joined at its ends 180 to berm structure 164 by couplers 181. In addition, a cut-out 182 may be formed in the tea bag-receiving indentation, as identified by indicium 166. Otherwise, lid 136 is configured the same as lid 36. Furthermore, bag holder 172 is so formed as to permit it to snap outwardly, as shown in FIG. 17, or inwardly as shown in FIG. 16. Its ability to hold a tea bag is depicted in FIG. 19, similarly to that as illustrated in FIG. 7.

Figure 20:
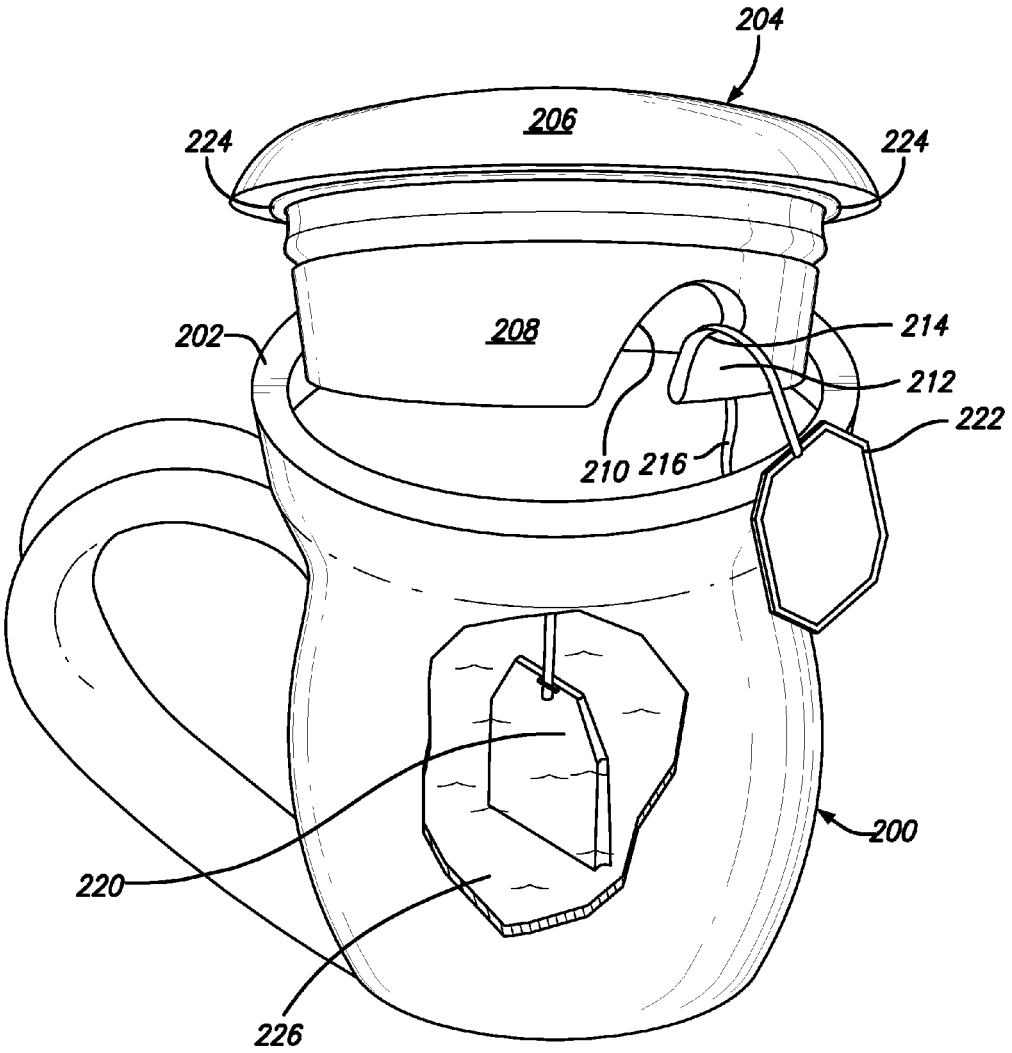
FIG. 20 is a perspective view of a fourth embodiment of the present invention illustrating a beverage container of ceramic or like constitution and lid therefore with a tea bag string held in its lid tea bag holding tab.
Figure 21:
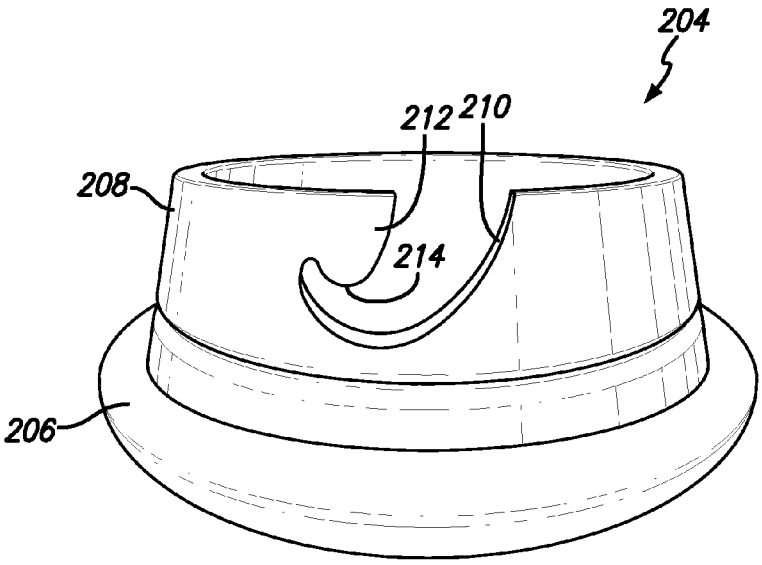
FIG. 21 is a perspective side view of the lid of the embodiment shown in FIG. 20.
Figure 22:
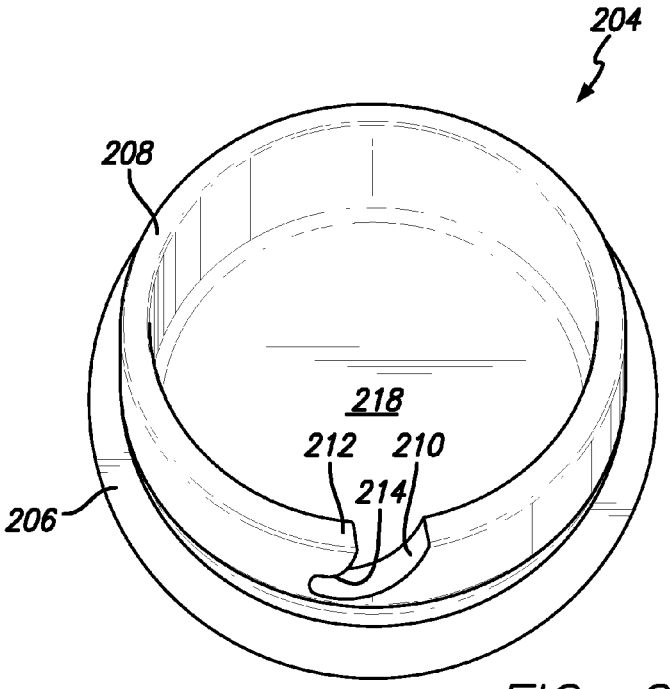
FIG. 22 is a perspective view illustrating the inside of the lid depicted in FIG. 21.

Referring now to FIGS. 20-22 which depict a fourth embodiment of the present invention, a ceramic cup or beverage container 200 has a mouth or lip 202 and a ceramic lid 204. While beverage container 200 and lid 124 are described as being of ceramic composition, it is to be understood that such composition is presented as typical and may comprise any suitable composition, whether inorganic or organic, e.g., hard plastic. Lid 204 includes an outer rim 206 having a depending ring-shaped portion or inside walled rim 208 which is disposed to fit within mouth 202 of cup 200 so that the lid will be firmly retained and secured to the cup.

A notch 210 or the like, having a latch or tab 212 or extension or fastening element, is provided with a hook-like implement 214. A tea bag string 216 is disposed to be wound about latch 212 and retained within the hook-like implement. As best shown in FIG. 22, depending ring-shaped portion 208 forms an encircling wall or rim to form a cup-shaped underside or bottom 218, which operates as a tea bag-receiving indentation in lid 202, for reception of a tea bag 220, as conventionally secured to string 218 at one end thereof. Also, conventionally, a tag or tail 222 is fastened to string 218 at its end opposite from that to which the tea bag is secured. As illustrated in FIG. 20, an O-ring 224 may be secured about inside rim 208 adjacent outer rim 206 to seal lid 204 within mouth 202 of cup 2100.

The utilization of the present invention, as shown in FIGS. 20-22, comprises the following steps. As shown in FIG. 20, tea bag string 216 is slid into notch 210 and wrapped about fastening element 212 as depicted, such that tea bag 220 is downwardly suspended from lid 204. Referring to FIG. 20, the lid is then placed atop cup or beverage container 200, covering its mouth 202, in such a manner that the tea bag is inserted within the cup and into the liquid, generally hot water (as designated by indicium 226), contained within the cup and that the tea bag string 216 and its tag 222 hang outside of the cup. After such time as the tea in the tea bag is steeped in the hot water, as desired by the user, as observed with respect to FIG. 20, lid 104 is slightly lifted from cup mouth 202 and, by gripping string 216 or tag 222, the tea bag is pulled from the hot water until it comes into contact within rim 208 of the lid. As illustrated in FIG. 22, the lid is then flipped over so that the tea bag rests inside the inner rim and on bottom 218. While these steps as depicted in FIGS. 20-22 are the preferred steps, it is to be understood that the user may otherwise manipulate the tea bag and the lid so as to attain the end result of having the tea bag reside within the lid bottom, e.g., by lifting the lid completely from the cup, grasping the tea bag with the fingers, and then placing the tea bag onto the bottom of the inverted lid.

Although the invention has been described with respect to particular embodiments thereof, it should be realized that various changes and modifications may be made therein without departing from the spirit and scope of the invention.

What is claimed is:

1. Implementation associable with a liquid immersible bag and its attached string before, during and after insertion of the bag into contained liquid and a container for containing the liquid and including a container lip, said implementation comprising:

a container-closing lid for closing the container, said container-closing lid having a receiving area configured to receive the bag after its immersion into the liquid;

a string-associable mechanism couplable to said container-closing lid to support the string, and thus to enable control of the bag before, during and after insertion thereof into the contained liquid, said string-associable mechanism including a bag holder having a bag holder rim which is configured to engage the container lip; and said container-closing lid has a rim which is configured to engage both the container lip and said bag holder rim, whereby said bag holder in combination with said lid forms a retainer retaining the bag within said lid receiving area and whereby said container-closing lid rim as engaged with said bag holder rim both grip the string against the container.

2. Implementation according to claim 1 wherein:

said bag holder further includes a central portion and an intermediary portion intermediary to said central portion and said bag holder rim, which said intermediary portion has a flat configuration;

said lid has a central portion and a berm intermediary to said lid rim and said lid central portion, which said berm has a flat configuration, whereby, when said bag holder and said lid are respectively engaged to said container lip, the flat portions of said bag holder intermediary portion and said lid berm contact one another, and where said lid rim and said bag holder rim when engaged provide a gripping engagement for the bag string, said gripping engagement enabling the bag string to be positioned with respect to said container respectively to enable the bag to be immersed into the liquid, to enable the bag to be removed from its immersion in the liquid, and to enable the bag to be held within said lid receiving area.

3. Implementation according to claim 1 wherein:

said bag holder further includes a central portion and an intermediary portion intermediary to said central portion and said bag holder rim, which said intermediary portion has a flat configuration;

said lid has a central portion and a berm intermediary to said lid rim and said lid central portion, which said berm has a flat configuration, whereby, when said bag holder and said lid are respectively engaged to said container lip, (a) said lid rim and said bag holder rim provide a gripping engagement for the bag string and (b) the contacting flat portions of said bag holder intermediary portion and said lid berm provide an additional gripping engagement for the bag string, said gripping engagements thus enabling the bag string to be positioned with respect to said container respectively to enable the bag to be immersed into the liquid, to enable the bag to be removed from its immersion in the liquid, and to enable the bag to be held within said lid receiving area.

4. Implementation associable with a liquid immersible bag and its attached string before, during and after insertion of the bag into contained liquid and a container for containing the liquid and including a container lip, said implementation comprising:

a lid adapted to close the container and having a receiving area configured to receive the bag after its immersion into the liquid, said lid including a rim adapted to engage the container lip and thereby seal the container; and a string-associable mechanism designed to be coupled to said lid, to support the string, and thus to enable control of the bag before, during and after insertion thereof into the contained liquid, said string-associable mechanism comprising a tab extending outwardly from said lid rim and having a bag string engaging enablement for the enabling control thereof before, during and after insertion of the bag into the contained liquid.

5. Implementation according to claim 4 in which said tab is configured as a flexible member and said bag string engaging enablement comprises a slit within said tab flexible member, whereby the bag string is insertable within said slit and thereby grippable by said flexible member to enhance the engagement between said lid rim and the container lip for thereby enhancing the enabling control of the bag before, during and after insertion of the bag into the contained liquid.

6. Implementation associable with a liquid immersible bag and its attached string before, during and after insertion of the bag into contained liquid and a container for containing the liquid and including a container lip, said implementation comprising:

a lid adapted to close the container and having a receiving area configured to receive the bag after its immersion into the liquid, said lid including an inside walled rim adjacent to and within said container lip and thereby extending within the container interior and an outer rim adapted to engage the container lip and thereby seal the container, and a rigid string engaging portion formed in said inside walled rim and defining a bag string engaging enablement, whereby selective parts of the bag string are wrappable about said rigid portion to define an engaging enablement for enabling control of the bag before, during and after insertion of the bag into the contained liquid.

7. Implementation according to claim 6 in which said lid and the container comprise a rigid material and said lid further includes a bowl-shaped interior surface bordered by said inside walled rim that defines said receiving area which is disposed to receive the bag after insertion thereof into the contained liquid.

8. A lid implementation associable with a liquid immersible bag and its attached string before, during and after insertion of the bag into contained liquid and a container for containing the liquid and including a container lip, said lid implementation comprising:

a base;

inner and outer walls surrounding said base and separated from one another to form a liquid conduit;

a rim terminating said base and adapted to engage the container lip and thereby seal said lid to the container;

said base comprising a central portion adapted to receive the bag after insertion thereof into the contained liquid, said inner wall generally skirting said central portion, a berm essentially separating said central portion from said skirting inner wall, at least one channel coupling said central portion and said conduit enabling flow of liquid essentially from said central portion to said conduit, coupling indents formed in said berm, and an outlet formed in said conduit enabling a user to access the liquid in the container; and a bag holder placeable over said base central portion and having protruding elements disposed to engage said berm coupling indents and enabling coupling of said bag holder to said berm, said bag holder thus enabling retention of the bag within said central portion.

9. Implementation associable with a liquid immersible bag and its attached string before, during and after insertion of the bag into contained liquid and a container for containing the liquid and including a container lip, a lid for closing the container having a receiving area configured to receive the bag after its immersion into the liquid, and a string-associable mechanism designed to be coupled to said lid, to support the string, and thus to enable control of the bag before, during and after insertion thereof into the contained liquid, said implementation comprising:

a bag holder having a rim which is configured to engage the container lip; and in which said lid includes a base comprising a central portion defining said receiving area which is adapted to receive the bag after insertion thereof into the contained liquid, a skirting wall skirting said central portion, a berm essentially separating said central portion from said skirting wall, at least one channel coupling said central portion and said skirting wall enabling flow of liquid essentially from said central portion adjacent to said skirting wall, and an outlet formed in said base enabling a user to access the liquid in the container, and a rim terminating said base and adapted (a) to engage the container lip and thereby seal said lid to the container and (b) to engage said bag holder rim to form a bag string holding combination and by which the bag, after insertion thereof into the contained liquid, is retained within said central portion.

10. Implementation for use with a liquid immersible bag and its attached string before, during and after insertion of the bag into contained liquid and, comprising:

a container having a lip and containing a liquid;

a lid for said container, said lid including ring-shaped inner and outer walls spaced from one another, a connecting wall connecting said inner and outer walls and defining therewith an annular liquid conduit, an opening in said connecting wall for enabling a user to imbibe the liquid from said container, a rim terminating said outer wall and adapted to engage said container lip and thereby to seal said lid to said container, and a central portion skirted by said inner wall, said central portion including a berm structure and a bag-receiving indentation adapted to receive the bag after insertion thereof into the contained liquid, channels formed in said berm structure coupling said bag-receiving indentation with said annular liquid conduit, and associated with said lid; and a bag holder placeable over said central bag-receiving indentation and having coupling structure disposed to engage said lid coupling structure for enabling coupling of said bag holder to said lid associated coupling structure by which said bag holder enables retention of the bag within said central bag-receiving indentation.

11. Implementation according to claim 10 further including a string-associated mechanism capable of selectively holding the string and thus enabling control of the bag before, during and after insertion of the bag into contained liquid, said mechanism comprising a tab of flexible material extending from said rim and having a bag string-engaging slit therein for the enabling control of the bag before, during and after insertion of the bag into contained liquid.

12. A method for use with a liquid immersible bag and its attached string before, during and after insertion of the bag into liquid and a container therefor, comprising the several steps of:

utilizing a lid for the container having a receiving area for receiving the bag after its immersion into the liquid;

immersing the bag into the liquid;

removing the bag from the liquid;

placing the bag within the receiving area;

holding the bag by a bag holder within the receiving area;

controlling movement and stopping movement of the bag selectively by use of said immersing, removing and placing steps, specifically by positioning the bag prior to immersion thereof into the liquid, by moving the bag into the liquid, by removing the bag from the liquid, and by placing the bag adjacent to the lid receiving area, said bag controlling movement and stopping movement step further comprising the steps of extending a string-engaging tab from the lid, and employing the tab in said bag controlling movement and stopping movement step to engage the string in the tab for enabling said movement and stopping movement controlling steps;

forming the tab as a flexible portion having a slit therein; and inserting the string within the flexible portion slit, whereby the bag string is thereby capable of being held by the flexible portion and thus enabling said movement and stopping movement controlling steps.

13. Implementation associable with a liquid immersible bag and its attached string before, during and after insertion of the bag into contained liquid and a container for containing the liquid and including a lip, said implementation comprising:

a container-closing lid for closing the container, said container-closing lid having a receiving area configured to receive the bag after its immersion into the liquid; and a string-and-bag-associable mechanism coupled to said container-closing lid, to support the string and to hold the bag within said lid receiving area, and thus to enable handling of the bag before, during and after insertion thereof into the contained liquid, said string-associable mechanism further including a bag holder having a bag holder rim which is configured to engage the container lip; and said container-closing lid has a rim which is configured to engage both the container lip and said bag holder rim, whereby said bag holder in combination with said lid forms a retainer retaining the bag within said lid receiving area and said container-closing lid rim as engaged with said bag holder rim both grip the string against the container lip.

14. Implementation associable with a liquid immersible bag and its attached string before, during and after insertion of the bag into contained liquid and a container therefor, comprising:

a lid closing the container and having a built-in receiving area built into and within said lid for receiving the bag after its immersion into the liquid, a first coupler formed in said lid; and a bag holder having ends, a second coupler affixed to said bag holder and affixed at said ends to said first coupler of said lid, whereby said bag holder and said lid built-in receiving area provide a space for receiving the bag when drawn by the string into the space so that the bag is securely captured by said bag holder within said lid receiving area.

* * * * *